US011038269B2

(12) United States Patent
Quarfoth et al.

(10) Patent No.: US 11,038,269 B2
(45) Date of Patent: Jun. 15, 2021

(54) ELECTRONICALLY STEERABLE HOLOGRAPHIC ANTENNA WITH RECONFIGURABLE RADIATORS FOR WIDEBAND FREQUENCY TUNING

(71) Applicant: HRL Laboratories, LLC, Malibu, CA (US)

(72) Inventors: Ryan G. Quarfoth, Los Angeles, CA (US); Carson R. White, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 16/519,374

(22) Filed: Jul. 23, 2019

(65) Prior Publication Data

US 2020/0083605 A1 Mar. 12, 2020

Related U.S. Application Data

(60) Provisional application No. 62/729,341, filed on Sep. 10, 2018.

(51) Int. Cl.
*H01Q 3/34* (2006.01)
*H01Q 13/10* (2006.01)

(52) U.S. Cl.
CPC ..... *H01Q 3/34* (2013.01); *H01Q 13/103* (2013.01)

(58) Field of Classification Search
CPC ..... H01Q 3/34; H01Q 13/103; H01Q 13/206
See application file for complete search history.

(56) References Cited

U.S. PATENT DOCUMENTS

| | | | | |
|---|---|---|---|---|
| 1,381,089 | A | 6/1921 | Beverage | |
| 2,402,622 | A | 6/1946 | Hansen | |
| 7,151,499 | B2 | 12/2006 | Avakian et al. | |
| 9,385,435 | B2 | 7/2016 | Bily et al. | |
| 9,450,310 | B2 | 9/2016 | Bily et al. | |
| 9,455,495 | B2 | 9/2016 | Gregoire | |
| 9,466,887 | B2 | 10/2016 | Gregoire et al. | |
| 9,698,479 | B2 | 7/2017 | Gregoire | |
| 9,871,293 | B2 | 1/2018 | Patel et al. | |
| 2015/0318618 | A1 | 11/2015 | Chen et al. | |
| 2015/0380828 | A1 | 12/2015 | Black et al. | |
| 2016/0261043 | A1* | 9/2016 | Sazegar | H01Q 21/0087 |
| 2017/0279193 | A1* | 9/2017 | Chauloux | H01Q 1/22 |
| 2017/0302004 | A1* | 10/2017 | Stevenson | H01Q 21/065 |

(Continued)

FOREIGN PATENT DOCUMENTS

| | | | |
|---|---|---|---|
| KR | 1020150042746 | A | 4/2015 |
| KR | 1020177027421 | A | 3/2016 |

OTHER PUBLICATIONS

Beverage, Harold H.; Rice, Chester W.; Kellogg, Edward W., "The Wave Antenna a New Type of Highly Directive Antenna," in American Institute of Electrical Engineers, Transactions of the, vol. XLXX, No., pp. 215-266, Jan. 1923.

(Continued)

*Primary Examiner* — Daniel D Chang
(74) *Attorney, Agent, or Firm* — Ladas & Parry

(57) ABSTRACT

A holographic antenna including a transmission line structure having a traveling wave mode along a length of the transmission line structure, and a plurality of reconfigurable radiating elements located along the length of the transmission line structure.

20 Claims, 11 Drawing Sheets

(56) References Cited

U.S. PATENT DOCUMENTS

2017/0331186 A1* 11/2017 Linn ..... H01Q 21/005
2018/0040960 A1* 2/2018 Johnson ..... H01Q 21/005

OTHER PUBLICATIONS

Jackson, D.R.; Cal oz, C.; Itoh, T., "Leaky-Wave Antennas," in Proceedings of the IEEE, vol. 100, No. 7, pp. 2194-2206, Jul. 2012.
Calor, C.; Itoh, T.; Rennings, A., "CRLH metamaterial leaky-wave and resonant antennas," in Antennas and Propagation Magazine, IEEE, vol. SO, No. 5, pp. 25-39, Oct. 2008.
D. Sievenpiper et al, "Holographic AISs for conformal antennas", 29th Antennas Applications Symposium, 2005.
D. Sievenpiper, J. Colburn, B. Fong, J. Ottusch and J. Visher., 2005 IEEE Antennas and Prop. Symp. Digest, vol. 18, pp. 256-259, 2005.
B. Fong et al, "Scalar and Tensor Holographic Artificial Impedance Surfaces," IEEE TAP., 58, 2010.
R. Quarfoth and D. Sievenpiper, "Artificial Tensor Impedance Surface Waveguides," in IEEE Transactions on Antennas and Propagation, voi. 61, No. 7, pp. 3597-3606, Jul. 2013.
R. G. Quarfoth and D. F. Sievenpiper, "Nonscattering Waveguides Based on Tensor Impedance Surfaces," in IEEE Transactions on Antennas and Propagation, vol. 63, No. 4, pp. 1746-1755, Apr. 2015.
A. M. Patel and A. Grbic, "A Printed Leaky-Wave Antenna Based on a Sinusoidally-Modulated Reactance Surface," in IEEE Transactions on Antennas and Propagation, vol. 59, No. 6, pp. 2081-2096, Jun. 2011.
Sievenpiper, D.; Schaffner, J.; Lee, J.J.; Livingston, S.; "A steerable leaky-wave antenna using a tunable impedance ground plane," Antennas and Wireless Propagation Letters, IEEE, vol. 1, No. 1, pp. 179-182, 2002.
Colburn, J.S.; Lai, A.; Sievenpiper, D.F.; Bekaryan, A.; Fong, B.H.; Ottusch, J.J.; Tulythan, P.; , "Adaptive artificial impedance surface conformal antennas," Antennas and Propagation Society International Symposium, 2009. APSURSI '09. IEEE, vol., No., pp. 1-4, Jun. 1-5, 2009.
Gregoire, D.J.; Colburn, J.S.; Patel, A.M.; Quarfoth, R.; Sievenpiper, D., "An electronically-steerable artificial-impedance-surface antenna," in Antennas and Propagation Society International Symposium (APSURSI), 2014 IEEE, vol., No., pp. 551-552, Jul. 6-11, 2014.
D. J. Gregoire, J. S. Colburn; A. M. Patel, R. Quarfoth and D. Sievenpiper, "An electronically-steerable artificial-impedance-surface antenna," 2014 IEEE Antennas and Propagation Society International Symposium (APSURSI), Memphis, TN, 2014, pp. 551-552.
Gregoire, D. J.; Patel, A.; Quarfoth, R., "A design for an electronically-steerable holographic antenna with polarization control," in Antennas and Propagation & USNC/URSI National Radio Science Meeting, 2015 IEEE International Symposium on, vol., No., pp. 2203-2204, Jul. 19-24, 2015.
R. G. Quarfoth, A. M. Patel and D. J. Gregoire, "Ka-band electronically scanned artificial impedance surface antenna," 2016 IEEE International Symposium on Antennas and Propagation (APSURSI), Fajardo, 2016, pp. 651-652.
V. A. Manasson et al., "Electronically reconfigurable aperture (ERA): A new approach for beamsteering technology," 2010 IEEE International Symposium on Phased Array Systems and Technology, Waltham, MA, 2010, pp. 673-679.
Smith, David R., Okan Yurduseven, Laura Pulido Mancera, Patrick Bowen, and Nathan B. Kundtz. "Analysis of a waveguide-fed metasurface antenna." Physical Review Applied 8, No. 5 (2017): 054048.
Balanis, Constantine A. "Antenna Theory: Analysis and Design." 3rd edition, Wiley Interscience(2005), see Chapter 6.
Corrected International Preliminary Report on Patentability from PCT/US2019/043056, dated Aug. 13, 2020.
International Preliminary Report on Patentability from PCT/CN2019/043056, dated May 18, 2020.
International Searching Authority from PCT/CN2019/043056, dated Nov. 8, 2019.
Written Opinion of the International Searching Authority from PCT/CN2019/043056, dated Nov. 8, 2019.
Yurduseven, Okan et al., "Dynamically reconfigurable holographic metasurface aperture for a Mills-Cross monochromatic microwave camera", Optics Express vol. 26, No. 5, Mar. 5, 2018.

* cited by examiner

| Position | Distance | Center Freq |
|---|---|---|
| AF | 9.5mm | 6 GHz |
| AE/BF | 7.6mm | 7.6 GHz |
| AD/BE/CF | 5.7mm | 10.1 GHz |
| AC/BD/CE/DF | 3.8mm | 15.2 GHz |

| Slot Edges | Distance | Center Freq |
|---|---|---|
| AF | 9.5mm | 6 GHz |
| AE | 8.6mm | 6.7 GHz |
| BF | 7.6mm | 7.6 GHz |
| BE | 6.7mm | 8.6 GHz |
| AD | 6.2mm | 9.3 GHz |
| CF | 5.7mm | 10.1GHz |
| CE | 4.8mm | 12.0 GHz |
| BD | 4.3mm | 13.4 GHz |
| AC | 3.8mm | 15.2 GHz |
| DF | 3.3mm | 17.5 GHz |

Straight Slot

Bent Slot

Annular Ring

Split Ring

Arbitrary

Rectangular waveguide

Ridged waveguide

Coaxial waveguide

Parallel Plate

ELECTRONICALLY STEERABLE HOLOGRAPHIC ANTENNA WITH RECONFIGURABLE RADIATORS FOR WIDEBAND FREQUENCY TUNING

CROSS REFERENCE TO RELATED APPLICATIONS

This application is related to and claims the benefit of U.S. Provisional Patent Application No. 62/729,341 filed on Sep. 10, 2018, which is incorporated herein by reference as though set forth in full.

STATEMENT REGARDING FEDERAL FUNDING

None

TECHNICAL FIELD

This disclosure relates to antennas and in particular, to holographic antennas and electronically scanned phased array antennas.

BACKGROUND

Prior Art holographic antennas have an operational bandwidth of less than 30%, limited by the bandwidth of the radiating element, and the instantaneous bandwidth is generally less than 3%, depending on the size of the antenna.

Electronically scanned phased array antennas or beamforming array antennas in the prior art can achieve a wide bandwidth by using a broadband antenna element. However, in order to use this element in an array, the element must have a length of less than half the wavelength on each side. Therefore, in order to achieve wideband operation, the antenna elements must be larger vertically, which has drawbacks in cost, array fabrication, and weight. Wideband phased arrays may be as much as 5× taller than holographic arrays and have more complicated fabrication and electronics, both of which increase cost.

In comparison, holographic antenna architectures have shown cost savings on the order of 3-5 times. The small thickness of a holographic array is generally on the order of 2 millimeters, which provides the potential for subarray panels to be folded and later deployed, such as by an operator. Further, holographic arrays have the potential to use significantly less power in receive mode because they have many fewer antenna elements. Phased arrays use significantly more power in receive mode because they have 15-20 times more receive modules than do holographic arrays.

Prior art holographic antenna designs may be both fixed-beam and electronically steerable. Leaky wave antennas (LWA) have been studied from as early as 1940 with slotted waveguides, as described in reference [1] below, which is incorporated herein by reference, and a precursor to these antennas was patented in 1921, as described in references [2, 3] below, which are incorporated herein by reference. LWAs are non-resonant antennas in which a wave propagates along the structure and radiates due to the characteristics of the mode supported by the antenna. LWAs can be split into two categories, namely uniform and periodic, as described in reference [4] below, which is incorporated herein by reference. Uniform antennas support a fast-wave mode in which the phase velocity of the antenna is greater than the speed of light. For this condition, the wave radiates based on the wavenumber of the mode along the antenna according to Equation (1):

$$\beta = k_0 \sin \theta, \tag{1}$$

where β is the wavenumber of the wave propagating along the antenna, $k_0$ is the wavenumber in free space, and e is the radiation angle with respect to the surface normal of the antenna. Quasi-uniform antennas operate similarly to uniform antennas but have subwavelength periodic loadings in order to improve the antenna characteristics. Composite Right-/Left-Hand (CRLH) transmission line antennas use capacitive and inductive loadings to allow improved beam scanning as describe in reference [5] below, which is incorporated herein by reference. However, these structures generally obtain beam scanning by changing their operating frequency, and this method is not compatible with multiple applications such as mobile satellite communication where a fixed operating frequency is necessary. Periodic LWAs use a slow wave guiding structure which has its wavenumber modulated. Under this condition, the antenna radiates an infinite number of spatial harmonics defined by Equation (2):

$$\beta = k_0 \sin \theta + m k_p, \tag{2}$$

where m is an integer which represents the spatial mode number and $k_p$ is the wavenumber of the modulation. The m=−1 mode is generally the most accessible modulation and other spatial modes predominantly have very minimal coupling or complex radiation angles when the m=−1 mode is excited. In this document, the terms "periodic LWA" and "holographic antenna" are used interchangeably. One early method used to create holographic antennas was artificial impedance surface antennas (AISAs), as described by references [6]-[8] below, which are incorporated herein by reference. These passive structures demonstrated high-gain beams and also polarization control. Surface-wave waveguides were used as a method to confine the travelling wave mode and allow easier biasing as described in references [9]-[11] below, which are incorporated herein by reference. AISAs can be electronically scanned by loading the structure with tunable elements such as varactors, as described by references [12]-[21] below, which are incorporated herein by reference. Other holographic structures have also been demonstrated as well, as described in references [22]-[26] below, which are incorporated herein by reference.

Prior art reconfigurable slot antennas are described by H. Li, J. Xiong, Y. Yu and S. He in "A Simple Compact Reconfigurable Slot Antenna With a Very Wide Tuning Range," IEEE Transactions on Antennas and Propagation, vol. 58, no. 11, pp. 3725-3728, November 2010, and by Symeon Nikolaou et al., in "Pattern and frequency reconfigurable annular slot antenna using PIN diodes," IEEE Transactions on Antennas and Propagation, vol. 54, no. 2, pp. 439-448, February 2006. These references are two examples of many that show reconfigurable slot architectures. These elements cannot be used as radiators for a holographic antenna without (1) being coupled to a traveling wave mode, (2) fitting into the subwavelength spacing needed for holographic antennas (~λ/10 at the highest frequency), (3) radiating at the appropriate rate to allow illumination over an electrically long traveling wave antenna, and (4) providing appropriate impedance to allow wave propagation. For a slot antenna element (or any other small antenna element) designed independently of application to holographic antennas it is almost certain that the element will not operate as desired within a holographic antenna. Further, the innovation of using a reconfigurable radiating element within a holographic antenna is not obvious and has not been previously published.

The following references are incorporated herein as though set forth in full.

REFERENCES

[1] W. W. Hansen, Radiating electromagnetic waveguide, U.S. Pat. No. 2,402,622, 1940.

[2] H. H. Beverage, Radio receiving system, U.S. Pat. No. 1,381,089, 1921.

[3] Beverage, Harold H.; Rice, Chester W.; Kellogg, Edward W., "The Wave Antenna A New Type of Highly Directive Antenna," in American Institute of Electrical Engineers, Transactions of the, vol. XLII, no., pp. 215-266, January 1923.

[4] Jackson, D. R.; Caloz, C.; Itoh, T., "Leaky-Wave Antennas," in Proceedings of the IEEE, vol. 100, no. 7, pp. 2194-2206, July 2012.

[5] Caloz, C.; Itoh, T.; Rennings, A., "CRLH metamaterial leaky-wave and resonant antennas," in Antennas and Propagation Magazine, IEEE, vol. 50, no. 5, pp. 25-39, October 2008.

[6] D. Sievenpiper et al, "Holographic AISs for conformal antennas", 29th Antennas Applications Symposium, 2005.

[7] D. Sievenpiper, J. Colburn, B. Fong, J. Ottusch and J. Visher., 2005 IEEE Antennas and Prop. Symp. Digest, vol. 1B, pp. 256-259, 2005.

[8] B. Fong et al, "Scalar and Tensor Holographic Artificial Impedance Surfaces," IEEE TAP., 58, 2010.

[9] R. Quarfoth and D. Sievenpiper, "Artificial Tensor Impedance Surface Waveguides," in IEEE Transactions on Antennas and Propagation, vol. 61, no. 7, pp. 3597-3606, July 2013.

[10] R. G. Quarfoth and D. F. Sievenpiper, "Nonscattering Waveguides Based on Tensor Impedance Surfaces," in IEEE Transactions on Antennas and Propagation, vol. 63, no. 4, pp. 1746-1755, April 2015.

[11] A. M. Patel and A. Grbic, "A Printed Leaky-Wave Antenna Based on a Sinusoidally-Modulated Reactance Surface," in IEEE Transactions on Antennas and Propagation, vol. 59, no. 6, pp. 2087-2096, June 2011.

[12] Sievenpiper, D.; Schaffner, J.; Lee, J. J.; Livingston, S.; "A steerable leaky-wave antenna using a tunable impedance ground plane," Antennas and Wireless Propagation Letters, IEEE, vol. 1, no. 1, pp. 179-182, 2002.

[13] Colburn, J. S.; Lai, A.; Sievenpiper, D. F.; Bekaryan, A.; Fong, B. H.; Ottusch, J. J.; Tulythan, P.; "Adaptive artificial impedance surface conformal antennas," Antennas and Propagation Society International Symposium, 2009. APSURSI '09. IEEE, vol., no., pp. 1-4, 1-5 Jun. 2009.

[14] Gregoire, Daniel J., and Joseph S. Colburn. "Low cost, 2D, electronically-steerable, artificial-impedance-surface antenna." U.S. Pat. No. 9,466,887. 11 Oct. 2016.

[15] Gregoire, Daniel J. "Two-dimensionally electronically-steerable artificial impedance surface antenna." U.S. Pat. No. 9,455,495. 27 Sep. 2016.

[16] Gregoire, Daniel J., Amit M. Patel, and Michael de la Chapelle. "Two-dimensionally electronically-steerable artificial impedance surface antenna." U.S. Pat. No. 9,698,479. 4 Jul. 2017.

[17] Patel, Amit M., and Ryan G. Quarfoth. "Two-dimensionally electronically-steerable artificial impedance surface antenna." U.S. Pat. No. 9,871,293. 16 Jan. 2018.

[18] Gregoire, D. J.; Colburn, J. S.; Patel, A. M.; Quarfoth, R.; Sievenpiper, D., "An electronically-steerable artificial-impedance-surface antenna," in Antennas and Propagation Society International Symposium (APSURSI), 2014 IEEE, vol., no., pp. 551-552, 6-11 Jul. 2014.

[19] D. J. Gregoire, J. S. Colburn, A. M. Patel, R. Quarfoth and D. Sievenpiper, "An electronically-steerable artificial-impedance-surface antenna," 2014 IEEE Antennas and Propagation Society International Symposium (APSURSI), Memphis, Tenn., 2014, pp. 551-552.

[20] Gregoire, D. J.; Patel, A.; Quarfoth, R., "A design for an electronically-steerable holographic antenna with polarization control," in Antennas and Propagation & USNC/URSI National Radio Science Meeting, 2015 IEEE International Symposium on, vol., no., pp. 2203-2204, 19-24 Jul. 2015.

[21] R. G. Quarfoth, A. M. Patel and D. J. Gregoire, "Ka-band electronically scanned artificial impedance surface antenna," 2016 IEEE International Symposium on Antennas and Propagation (APSURSI), Fajardo, 2016, pp. 651-652.

[22] Avakian, Aramais, et al. "Reconfigurable dielectric waveguide antenna." U.S. Pat. No. 7,151,499. 19 Dec. 2006.

[23] V. A. Manasson et al., "Electronically reconfigurable aperture (ERA): A new approach for beam-steering technology," 2010 IEEE International Symposium on Phased Array Systems and Technology, Waltham, Mass., 2010, pp. 673-679.

[24] Bily, Adam, et al. "Surface scattering antenna improvements." U.S. Pat. No. 9,385,435. 5 Jul. 2016.

[25] Bily, Adam, et al. "Surface scattering antennas." U.S. Pat. No. 9,450,310. 20 Sep. 2016.

[26] Smith, David R., Okan Yurduseven, Laura Pulido Mancera, Patrick Bowen, and Nathan B. Kundtz. "Analysis of a waveguide-fed metasurface antenna." Physical Review Applied 8, no. 5 (2017): 054048.

[27] Balanis, Constantine A. "Antenna Theory: Analysis and Design." 3rd edition, Wiley Interscience (2005), see Chapter 6.

What is needed is an electronically steerable holographic antenna with wideband frequency tuning. The embodiments of the present disclosure answer these and other needs.

SUMMARY

In a first embodiment disclosed herein, a holographic antenna comprises a transmission line structure having a traveling wave mode along a length of the transmission line structure, and a plurality of reconfigurable radiating elements located along the length of the transmission line structure.

In another embodiment disclosed herein, a holographic antenna comprises a rectangular waveguide, a plurality of radiating elements located along a length of the rectangular waveguide, a plurality of tuning devices, a respective set of the plurality of tuning devices coupled to each respective radiating element of the plurality of radiating elements, wherein each respective set of the plurality of tuning devices has a uniform or non-uniform spacing across a width of the respective radiating element.

In yet another embodiment disclosed herein, a method of providing a holographic antenna comprises providing a printed circuit board having multiple layers, forming a metallic top layer of a transmission line structure on top of the printed circuit board, forming a metallic bottom layer of the transmission line structure on an internal layer of the printed circuit board, forming a plurality of metallic vias coupled between the top layer of the transmission line structure and the bottom layer of the transmission line structure, forming a plurality of radiating elements in the top layer of the transmission line along a length of the transmission line, and providing a plurality of tuning devices, a respective set of the plurality of tuning devices coupled to each respective radiating element of the plurality of radiating elements, wherein each respective set of the plurality of tuning devices has a uniform or non-uniform spacing across a width of the respective reconfigurable radiating element.

These and other features and advantages will become further apparent from the detailed description and accompanying figures that follow. In the figures and description, numerals indicate the various features, like numerals referring to like features throughout both the drawings and the description.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The described invention is for an electronically steerable holographic antenna with reconfigurable radiating elements. The preferred embodiment is a rectangular waveguide with slot radiating elements spaced along the rectangular waveguide at a sub-wavelength of the traveling wave mode of the antenna. The antenna uses traditional holographic beam steering techniques. A periodic pattern of open and shorted slots is applied along the length of the antenna. The beam steering direction is based on the periodicity of open and shorted slots. Switches are used to control whether a slot is open or shorted, and the periodicity can be reconfigured electronically, thus providing electronic beam steering. The present disclosure describes multiple switches that are placed in each radiating element, so that by operating the switches, the effective length of the slot can be changed. Each of the switches in the slot are independently controllable, and this allows the slot to take on a discrete set of lengths based on the number of switches and their positions. The operational frequency of the holographic antenna is based on the length of the slot, so the frequency of the holographic antenna can be reconfigured by shorting out portions of the slot. The preferred embodiment provides a 3:1 tuning range while still allowing wide angle beam steering. Other embodiments could provide wider tuning ranges or steering ranges.

Figure 4:
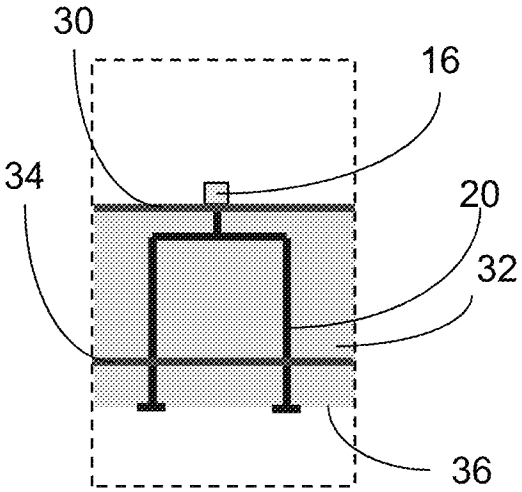
FIG. 4 shows side view of a unit cell in accordance with the present disclosure.
Figure 3:
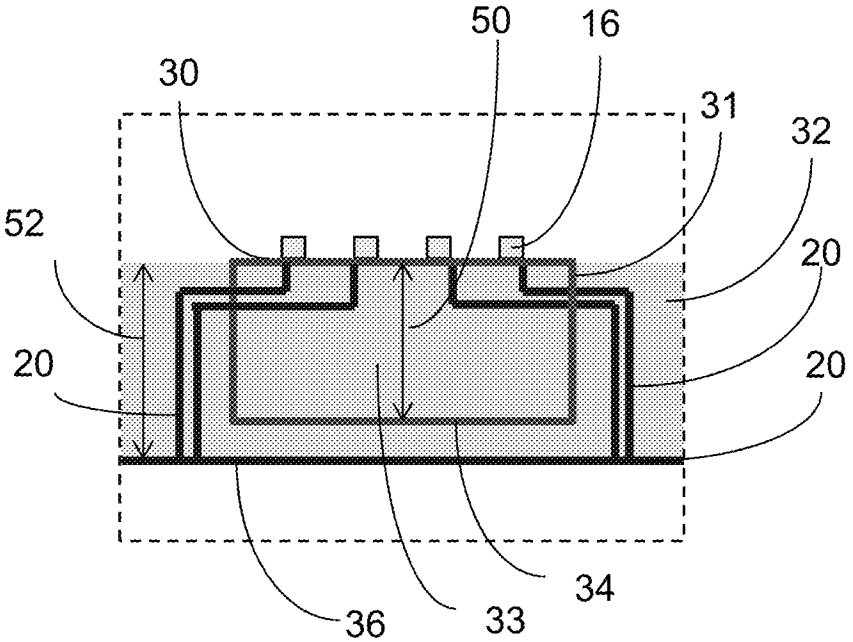
FIG. 3 shows a front view of unit cell in accordance with the present disclosure.

Four components are used together to form the electronically steerable holographic antenna with reconfigurable radiators for wideband frequency tuning: a transmission line structure 12, radiating elements 14, tuning devices 16 in the radiating elements, and bias lines 20 that provide individually-controllable voltages to the tuning devices. Note that in FIG. 3 the bias lines 20 appear to be shorted together; however, this is due to the perspective of the figure and in fact the bias lines 20 in FIG. 3 are not shorted together. FIG. 4 makes it clear that the bias lines 20 are independently addressable.

The transmission line structure 12 supports a traveling wave mode. Radiating elements 14 containing the tuning devices 16 are located periodically along the transmission line structure to provide reconfigurability. The tuning devices have two purposes. The first purpose is to apply an overall holographic pattern to the antenna, so that the antenna radiates a beam in a desired direction as described in equation (2). The second purpose is to reconfigure the length of the radiating element in order to change the frequency of operation.

Figure 1A:
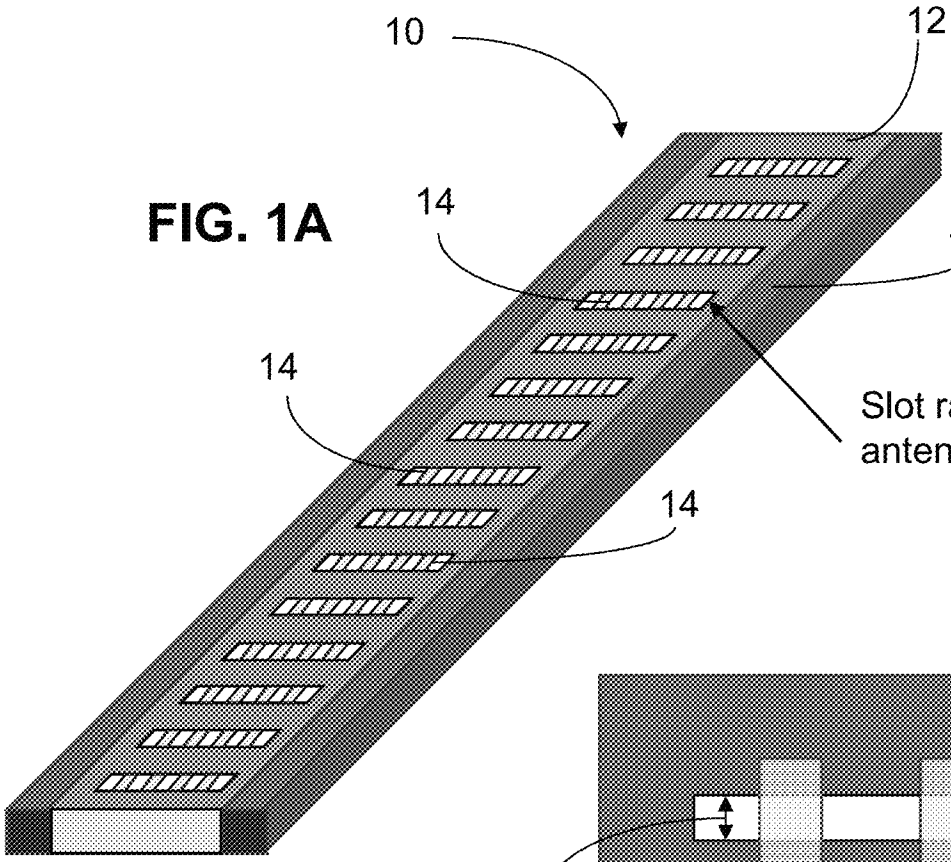
FIG. 1A shows a perspective view of the antenna and FIG. 1B shows slot radiating elements, and tuning devices in accordance with the present disclosure.
Figure 1B:
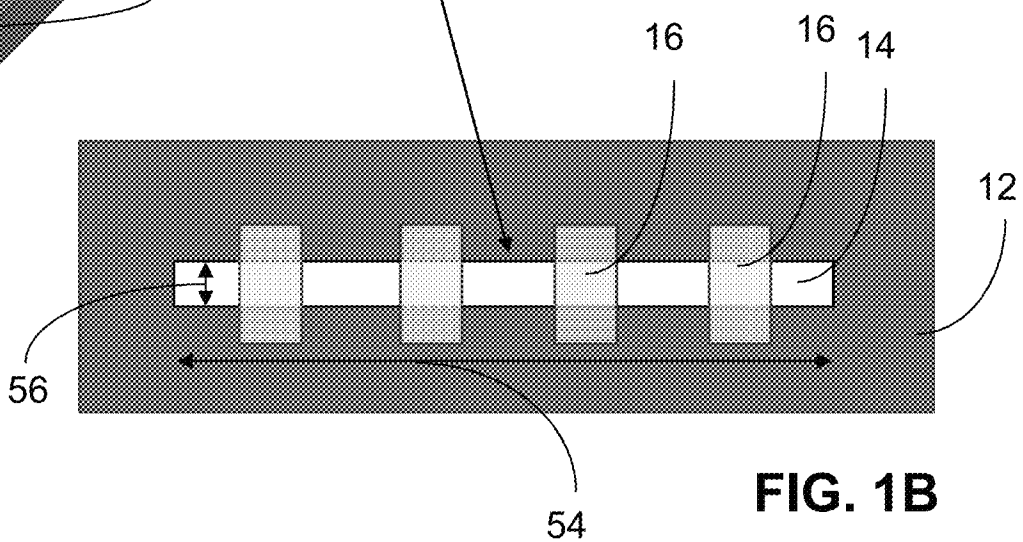

FIGS. 1A and 1B show an antenna 10 that has a transmission line 12, radiating elements 14 along the transmission line 12, and tuning devices 16 along the radiating element 14, which in the embodiment shown are radiating slots 14. Bias lines are not shown in FIGS. 1A and 1B, but may be located at the edges 18 of the transmission line 12. The antenna 10 may be constructed using a printed circuit board which is a laminate consisting of layers of metal and layers of dielectric. Plated metal vias may be used to provide conductive connections vertically between horizontal metal layers.

Figure 2:
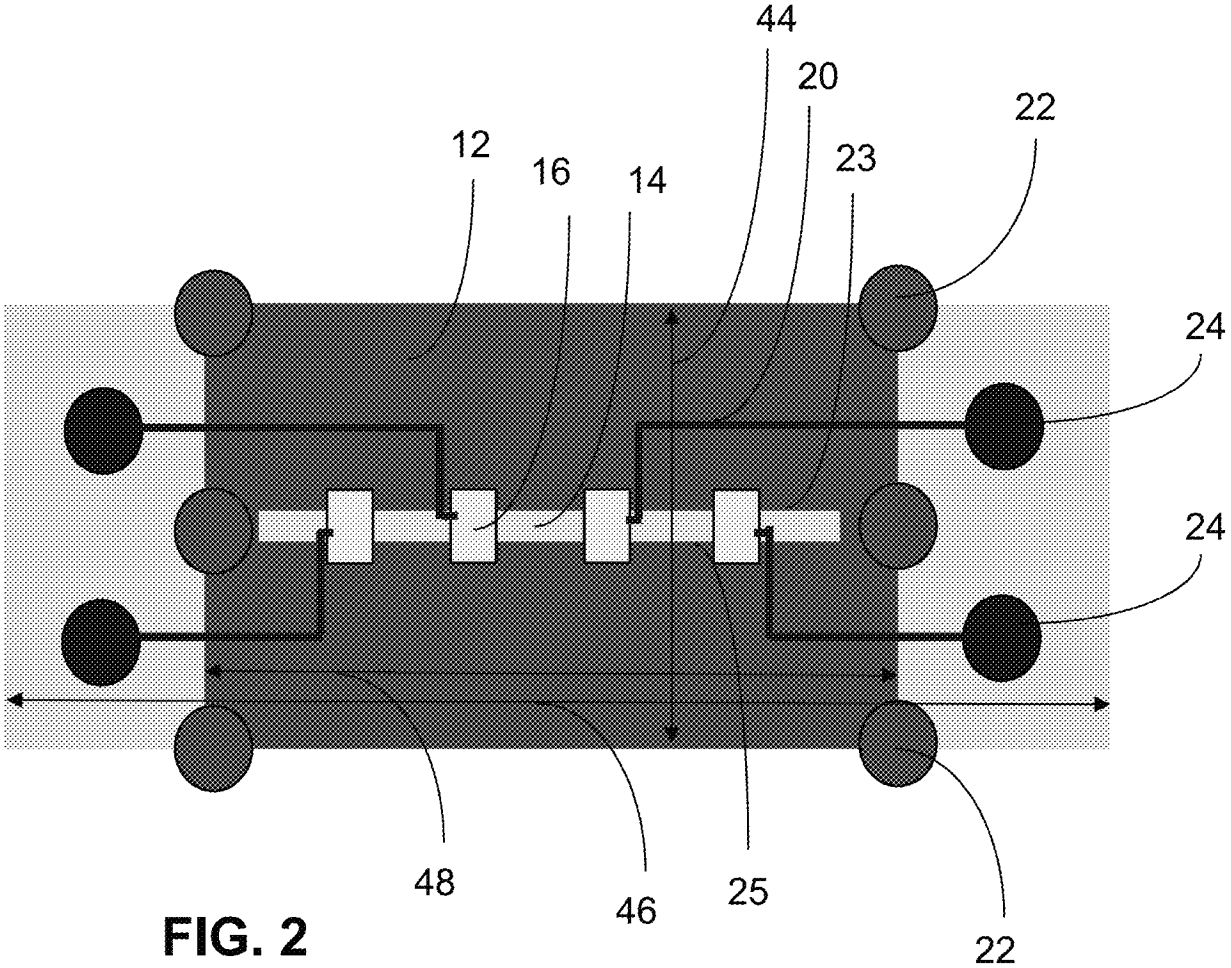
FIG. 2 shows a more-detailed unit cell top view of the structure in accordance with the present disclosure.

FIG. 2 shows a top view of a portion of the antenna 10, showing a slot 14 with tuning devices 16 controlled by bias lines 20. The waveguide 12 may be constructed with metal sheets in the horizontal plane creating top and bottom walls, and vertical vias 22 creating the side walls to form a substantially rectangular waveguide 12. Bias lines 20 are connected to the tuning devices 16 and to metal layers beneath the antenna 10 using vias 24.

The red rectangle 31 in FIG. 3 represents the four walls of the waveguide. The top and bottom walls are solid metal that is located on the PCB. The side walls are created by the vias 22 and they make contact with the top and bottom layers. In order be a "wall" electromagnetically-speaking these vias are spaced closer than than the wavelength. With this small spacing the vias form a "wall" that electromagnetic (EM) waves can not penetrate. Other names for this are via fence, conductive fence, or more generally faraday cage.

As shown in FIG. 2 the tuning devices 16 are connected across the slot 14. The tuning devices 16 may be switches 16 that are connected across the slot 14 at different positions along the slot. Each switch 16 may have one electrode touching one side 23 of the slot and another electrode touching another side 25 of the slot 16. The switch 16 is controlled by a bias line 20, which controls the state of the switch 16 by applying a voltage or current. In the "short" state, the switch provides a zero impedance or low impedance, which may be less than 10 ohms, between the first side 23 and the second side 25 of the slot 16. In the "open" state, the switch provides a high impedance, which may be greater than 100 ohms, between the between the first side 23 and the second side 25 of the slot 16.

Figure 8A:
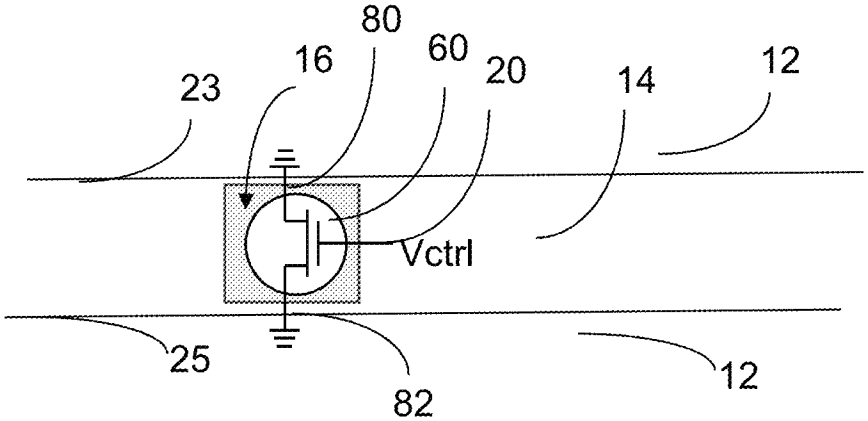
FIGS. 8A, 8B, 8C, and 8D show the device topology in relation to the slot and show single- and multi-transistor tuning device architectures in accordance with the present disclosure.

In general, slot antennas radiate power at a given frequency if they are sized appropriately. The tuning devices or switches 16 can change the effective length of the slot 14. So, for example, if the appropriate slot length for radiating at a frequency f is L, and if with a length of L/2 radiation is prevented, then by placing a switch in the middle of the slot 14, the slot can be switched from a radiating slot to a non-radiating slot. In the "open" state the effective length is L, and the slot radiates. In the "short" state the slot does not radiate. In the "short" state the slot does not radiate because the slot is changed to two L/2 slots and neither of them will radiate at frequency f. FIG. 8A shows a switch 16 implemented with a field effect transistor (FET) 60 that has a source electrode 80 connected to the first side 23 of the slot 14 and a drain 82 electrode connected to the second side 25 of the slot 14. The first side 23 and the second side 25 of the slot 14 are continuous with the waveguide 12. By controlling the gate of the FET with bias line 20 the FET switch 60 may be controlled to be in the "short" or the "open" state.

FIG. 3 shows an illustration of a front elevation view of the antenna structure 10. The top layer 30 of the transmission line 12 may be on the top layer of a printed circuit board (PCB) or dielectric 32 and the bottom layer 34 of the transmission line 12 may be on an internal layer of the PCB to provide space for biasing lines 20 beneath the antenna 10. Bias lines 20 come up from the lower bottom layer 36 to the tuning devices 16. Using the bottom layer 36, or any number of additional layers below the antenna 10, the bias lines 20 can be connected to traditional biasing hardware, such as digital-to-analog converters, digital input control lines, and so on. It is preferred that a horizontal extent of the unit cell be on the order of half the wavelength of the lowest frequency of operation so that holographic antenna elements can be arrayed horizontally to provide two-dimensional beam steering. FIG. 4 shows a side view of the unit cell. The horizontal extent is the horizontal direction of FIG. 3 and this is also the unit cell width 46 shown in FIG. 2 and discussed further below.

The antenna may be fabricated using wafer-based fabrication and assembly with tuning devices integrated on-wafer together with the traveling wave structure and the radiators. The traveling wave structure and radiator may also be machined and coupled to a circuit board or a wafer with the tuning devices.

Figure 5:
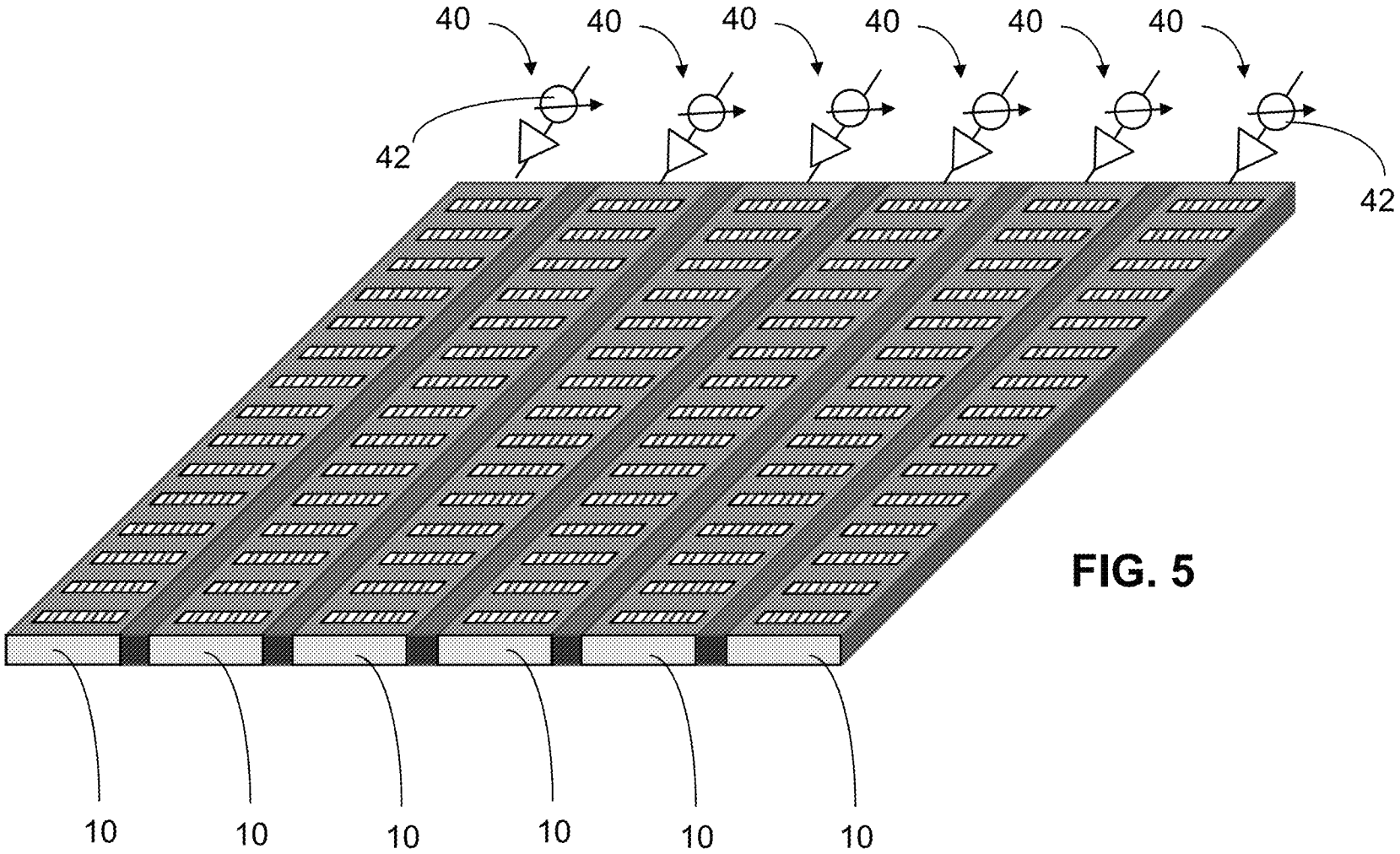
FIG. 5 shows a perspective view of a two-dimensional (2D) array in accordance with the present disclosure.

FIG. 5 shows an illustration of a 2D array with 6 holographic antenna elements 10, each of which may be the same as antenna 10 shown in FIG. 1A. Each holographic antenna element 10 may be fed from a feed network 40 by conventional means and with input phase controlled by a phase shifter 42. This architecture allows 2D beam steering enabled by the hologram antenna element 10 in one dimension and the phase shifters in the second dimension, as described in references [14]-[17] above, which are incorporated herein by reference.

In a preferred embodiment each unit cell, as shown in FIG. 1B, FIG. 2 and FIG. 3, of each holographic antenna element 10 may have the following parameters which were determined by simulation: a 2 mm unit cell length 44; a 13 mm unit cell width 46; an 11 mm waveguide width 48; a 150 mil waveguide height 50; a 162 mil total unit cell height 52; 9.5 mm slot width 54; 0.4 mm slot length 56; a dielectric constant of 6 for the dielectric; and copper for the metal in the waveguide 12, vias 22 and 24, and bias lines 20. Depending on the frequency of operation or manufacturing method, other lengths, widths, or materials can be used.

An electromagnetic wave (EM wave) which travels along the structure through the transmission line 12. The transmission line 12 is preferred to be electrically long, meaning multiple wavelengths long. A preferred embodiment of the transmission line 12 may have the following characteristics: operates over a 3:1 frequency range (6-18 GHz), is filled with a dielectric with a dielectric constant of 6, is a rectangular waveguide, has a length that is 12.8 wavelengths long at the center of the operational frequency band, or 320 mm long at 12 GHz, and that is sized to have a frequency cutoff just below the bottom of the operating frequency range.

Figures 6A, 6B:
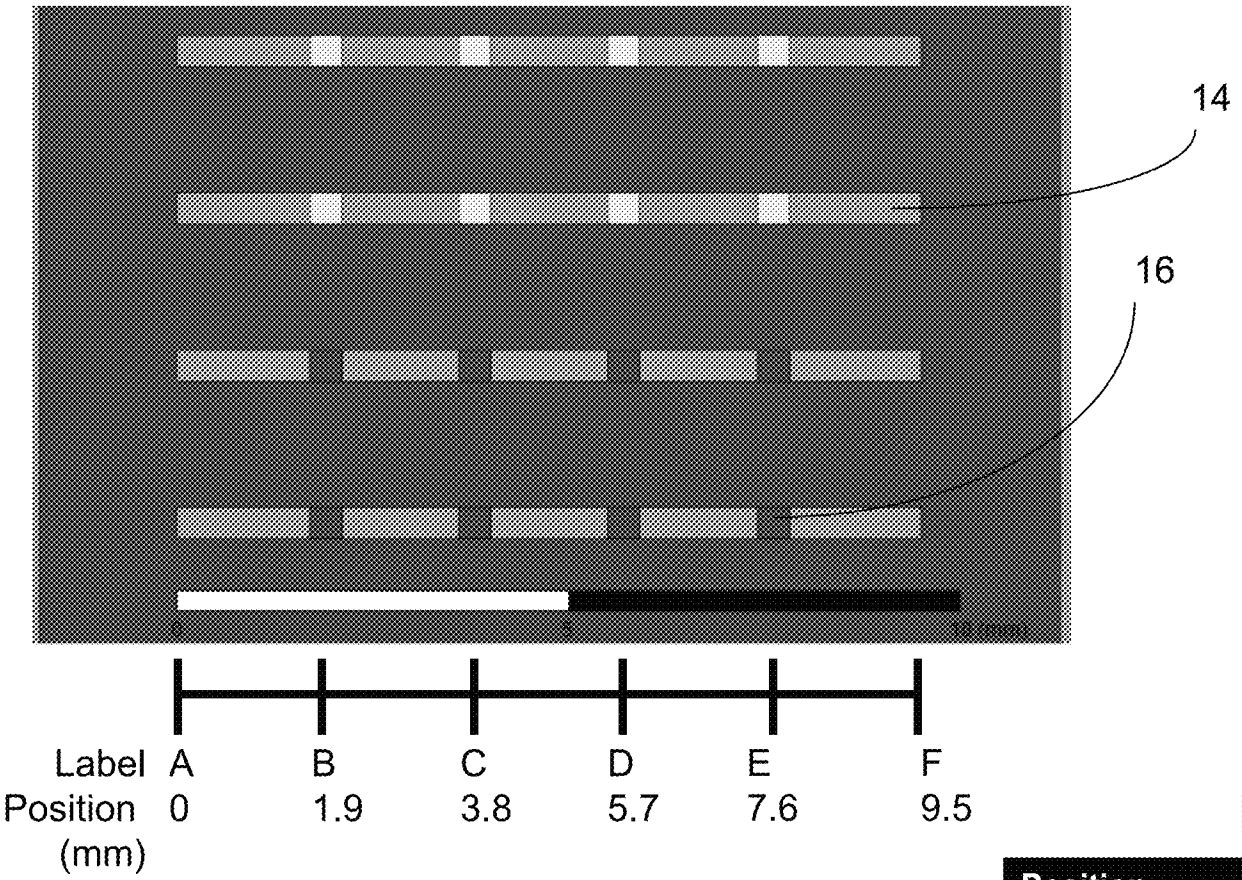
FIG. 6A shows an example of four tuning devices and FIG. 6B shows the positions of the tuning devices in accordance with the present disclosure.

Radiating elements 14 are loaded periodically along the transmission line 12 structure and one or more tuning devices 16 is coupled to each radiating element 14. A preferred embodiment of a radiating element is a slot 14 with four tuning devices 16. Each tuning device 16 may be a single FET transistor. Any number of tuning devices 16 greater than one coupled to a radiating element 14 can provide frequency of operation reconfigurability. Increasing the number of tuning devices increases the number of tuning states that the radiating element 14 can achieve. An example showing four tuning devices is shown in FIG. 6A. Using full wave simulation, it has been found that an optimal slot length for 6 GHz is 9.5 mm which is represented between positions A and F in FIG. 6A.

The effective length of the slot radiator 14 can be changed by switching the appropriate tuning devices 16 to a "short" or ON state. For example, the effective slot width is only the distance between A and E if the tuning device at position E is turned ON or is put in an "short" state in every row of the antenna. In this example, only the tuning devices in positions B, C, and D would be in the "open" or OFF state. The result is a slot that is 7.6 mm wide which resonates at 7.6 GHz.

As seen in FIG. 6B, different combinations of switches create center frequencies ranging from 6-15 GHz. Note that the operational bandwidth for each effective slot width is approximately +−20% of the center frequency. So, for the embodiment of FIG. 6A, there are frequency ranges where the antenna cannot operate efficiently. In FIG. 6A each slot 14 has four tuning devices 16 that are uniformly spaced across the width of the slot 16. The four tuning devices 16 from one edge of the 9.5 mm wide slot are at locations 1.9 mm, 3.8 mm, 5.7 mm, and 7.6 mm.

Figures 7A, 7B:
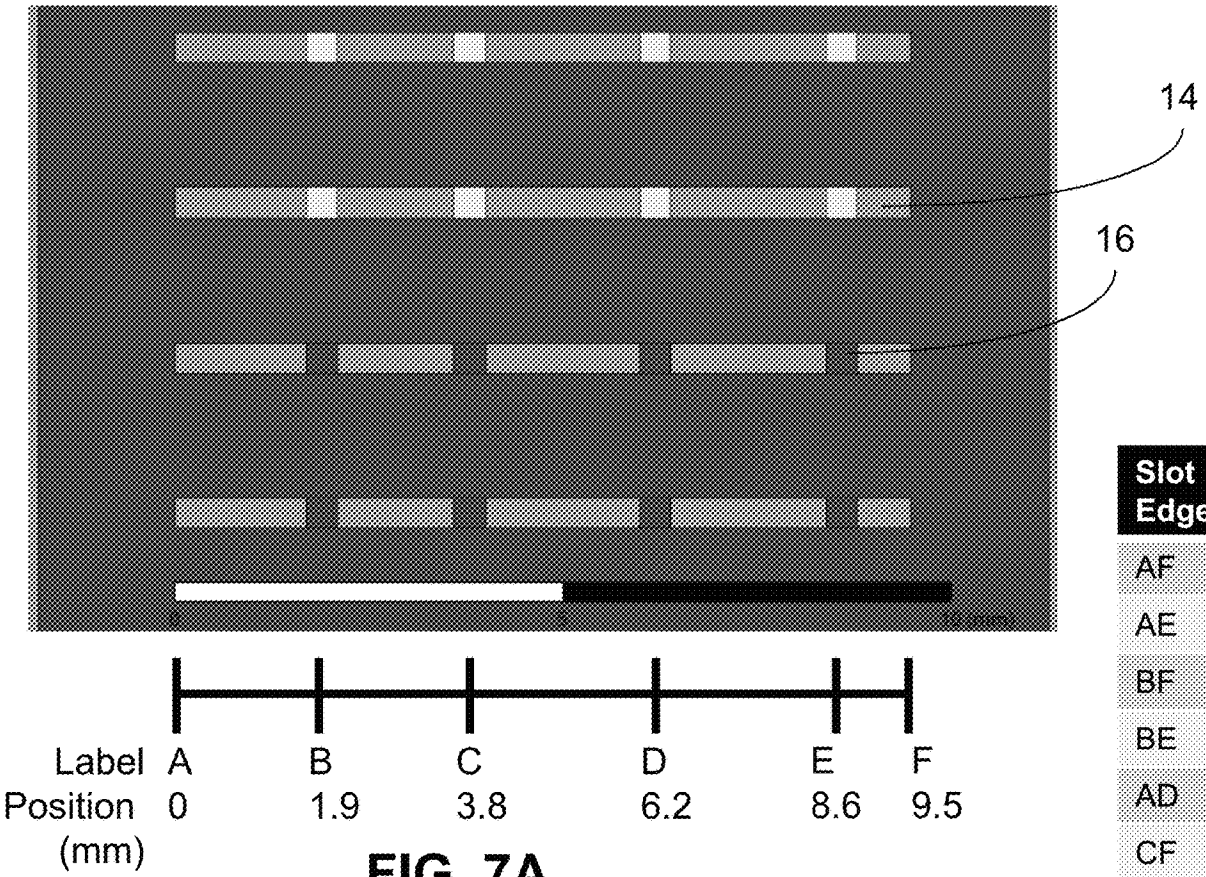
FIGS. 7A and 7B show an adjustment to the tuning device positions of FIG. 6 that allow continuous operation between 6-18 GHz in accordance with the present disclosure.

By spacing the tuning devices non-uniformly, many more slot lengths can be achieved and thus more center frequencies can be achieved. FIGS. 7A and 7B show that by adjusting the tuning device positions, continuous frequency of operation between 6-18 GHz is provided. Again, it is noted that the operational bandwidth of a specific slot length is approximately 20% of the center frequency. Therefore, FIG. 7 provides a preferred embodiment. In FIG. 7A each slot 14 has four tuning devices 16 that are non-uniformly spaced across the width of the slot 16. In FIG. 7A, the four tuning devices 16 from one edge of the 9.5 mm wide slot are at locations 1.9 mm, 3.8 mm, 6.2 mm, and 8.6 mm.

Bias lines 20 provide independent voltage control for each tuning device 16. The metal surrounding the slot 14 is the transmission line structure 12, which may be at ground. The bias lines 20 can be brought in from a lower plane of the antenna 10 as shown in FIGS. 2, 3, and 4.

A preferred embodiment uses multiple tuning devices 16 across the slot 14, with each single one of the multiple tuning devices 16 being a single transistor FET switch 60, as shown in FIG. 8A. FIG. 8A shows a switch 16 implemented with a field effect transistor (FET) 60 that has a source electrode 80 connected to the first side 23 of the slot 14 and a drain electrode 82 connected to the second side 25 of the slot 14. The first side 23 and the second side 25 of the slot 14 are continuous with the waveguide 12. By controlling the gate of the FET with bias line 20 the FET switch 60 may be controlled to be in the "short" or the "open" state.

Figure 8B:
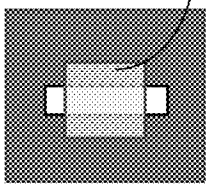
Figure 8C:
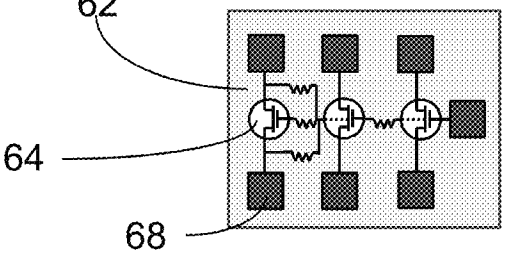
Figure 8D:
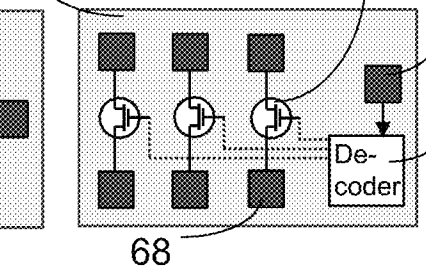

At higher frequencies, the width of a slot 14 may be narrower and in that case it may be challenging to fit multiple single transistor FET switches 60 across the slot 14. In such a case an integrated tuning device 62, as shown in FIG. 8B, may be used for each slot 14. The integrated tuning device 62 integrates multiple tuning elements into the integrated tuning device, which may be an integrated circuit or a monolithic integrated circuit. Two examples of integrated tuning devices 62 are shown in FIGS. 8C and 8D. FIG. 8C shows a series of 3 transistors 64 that may be fed by a resistive network that controls which devices are ON or in a "short" state based on an analog voltage input. Pads 68 are on the integrated tuning device 62 and connected to the transmission line structure 12. The example of FIG. 8D also has three transistors 64 which are controlled by a decoder 70, which decodes either a digital or analog input 71 to set the state of each of the transistors 64 to be either in a "short" state or in an "open" state across the slot 14. For example, one of the transistors 64 may be in a "short" state, while the other two transistors 64 are in an "open" state. Three transistors 64 are shown within the multi-transistor tuning device examples of FIGS. 8C and 8D; however, any number of transistors may be used for various applications. Also, more than one of these integrated tuning devices 62 may be used to control the effective width and therefore the operating frequency of a single slot 14. Also, the tuning device 62, shown as transistors in FIGS. 8A, 8C and 8D, may also be implemented using micro-electro-mechanical systems (MEMS) switches, phase change material (PCM) switches, semiconductor switches, other switches, or any two state (ON/OFF) or "short"/"open" device.

Figure 9A:
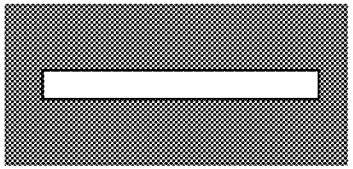
FIGS. 9A, 9B, 9C, 9D and 9E show different slot geometries in accordance with the present disclosure.
Figure 9B:
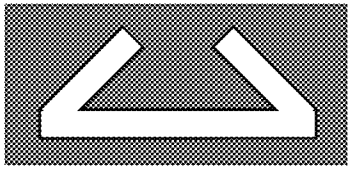
Figure 9C:
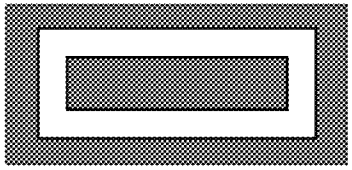
Figure 9D:
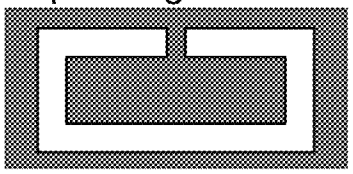
Figure 9E:
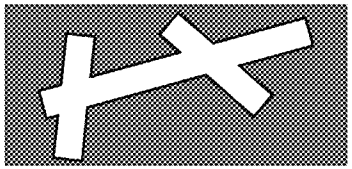

The preferred embodiment for a slot is a straight slot, as shown in FIG. 9A; however, other slot geometries are possible. The slot may be a straight slot, a bent slot, an annular ring, a split ring, or a slot of arbitrary geometry, as shown in FIGS. 9A, 9B, 9C, 9D and 9E, respectively.

Figure 10A:
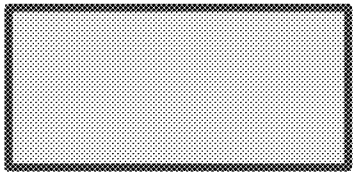
FIGS. 10A, 10B, 10C and 10D show different transmission line geometries in accordance with the present disclosure.
Figure 10B:
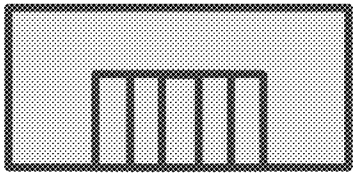
Figure 10C:
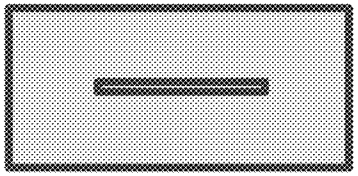
Figure 10D:
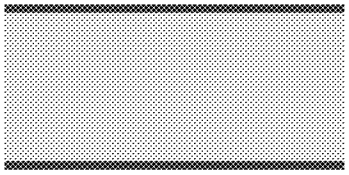

The preferred embodiment of the transmission line is a rectangular waveguide, as shown in FIG. 10A. However, other transmission line geometries may be used, such as a ridged waveguide, a coaxial waveguide, or a parallel plate, as shown in FIGS. 10B, 10C and 10D, respectively. Each of these other geometries may provide improved bandwidth.

Figure 11:
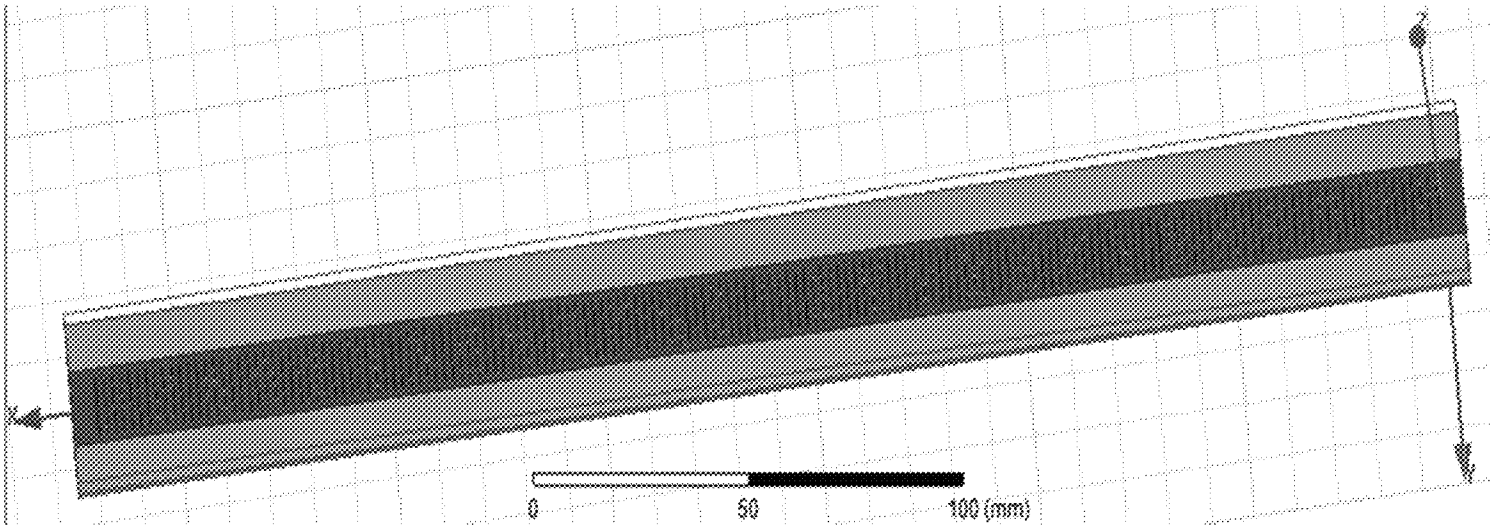
FIG. 11 shows a geometry used for simulation of the antenna performance in accordance with the present disclosure.
Figure 12:
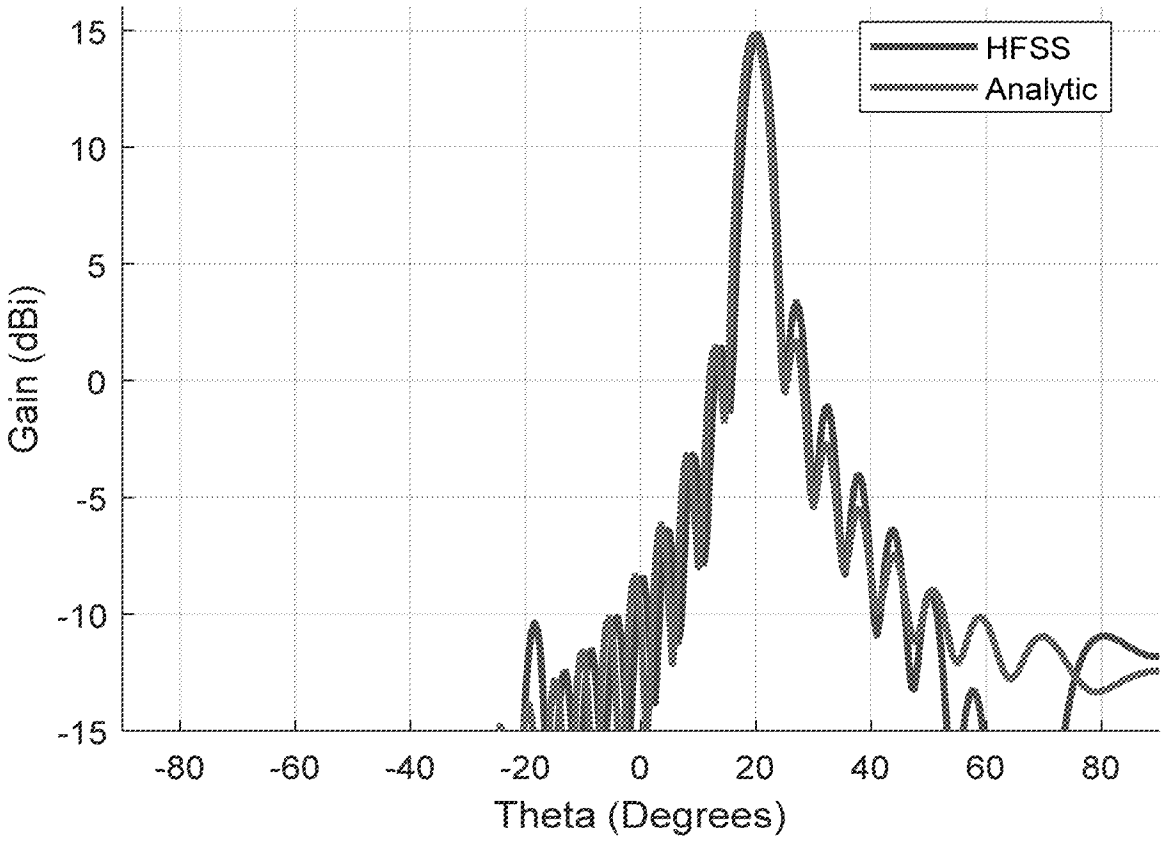
FIG. 12 shows simulation results compared to an analytic formulation in accordance with the present disclosure.
Figure 13:
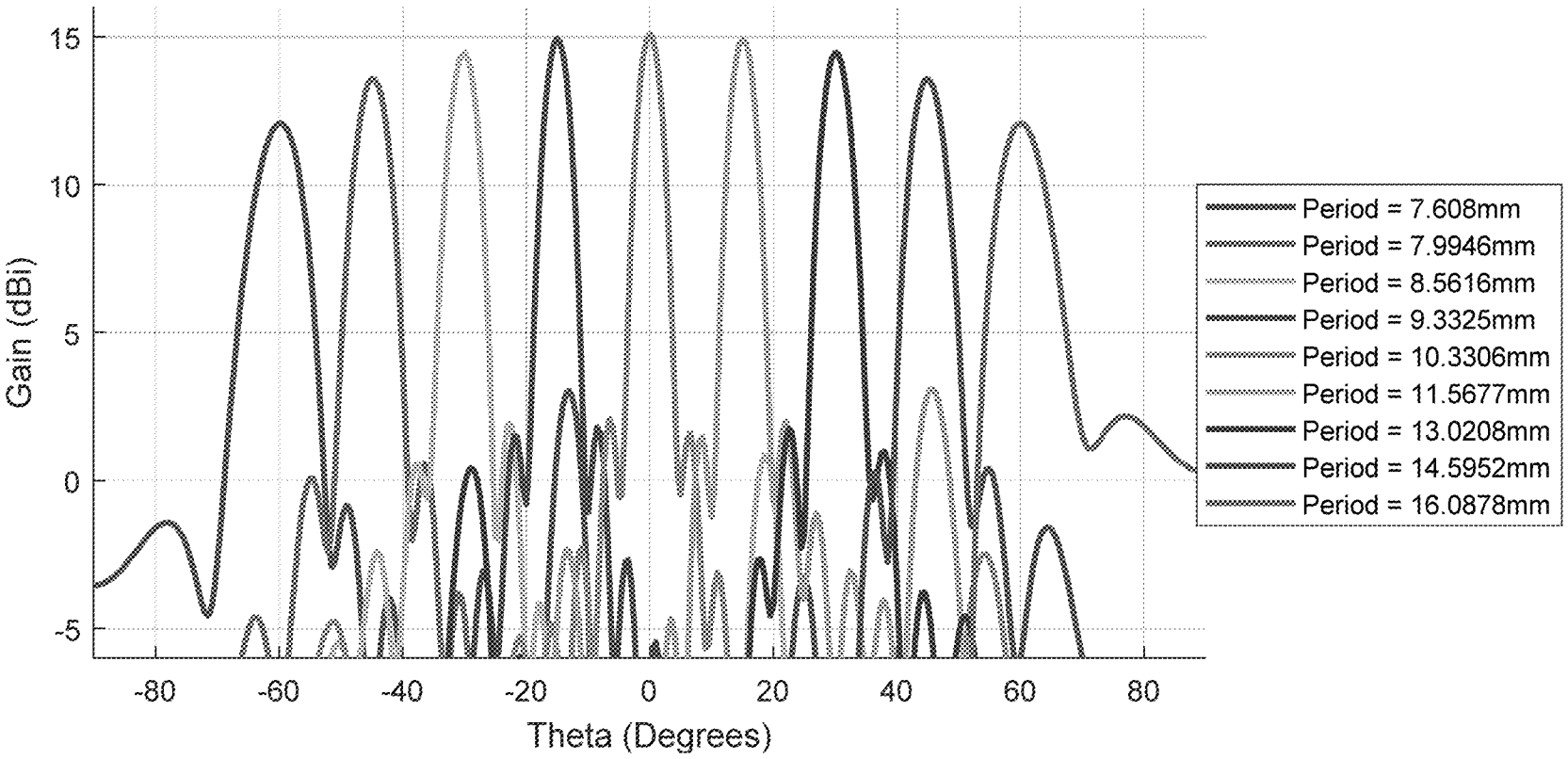
FIG. 13 shows analytic results of a sweep of modulation period showing wide-angle beam steering in accordance with the present disclosure.

A preferred embodiment with a straight slot and a rectangular waveguide has been simulated in a full-wave 3D electromagnetic solver (ANSYS HFSS) in order to determine its performance. The simulation geometry of the structure is shown in FIG. 11, which is a zoomed out view of FIG. 1A, and this structure has been simulated at multiple frequencies. FIG. 12 shows the simulation results for a 12 GHz center frequency. The analytic formulation is an array factor analysis that is calculated by traditional methods for antenna arrays, as described in reference [27], which is incorporated herein by reference. FIG. 13 shows analytic results of a sweep of modulation period showing that the antenna 10 is capable of wide-angle beam steering. FIG. 13 shows a legend showing the different modulation periods, kp, which is the spatial domain representation of the period kp=2*pi/period.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . ."

What is claimed is:

1. A holographic antenna comprising:

a transmission line structure having a traveling wave mode along a length of the transmission line structure; and a plurality of reconfigurable radiating elements located along the length of the transmission line structure;

a plurality of tuning devices coupled to and arranged along at least one respective reconfigurable radiating element of the plurality of reconfigurable radiating elements; and a plurality of bias lines, wherein a respective bias line is coupled to a respective tuning device for controlling the respective tuning device of the plurality of tuning devices to be shorted to the transmission line structure or to be not shorted to the transmission line structure to reconfigure the respective reconfigurable radiating element to steer a radiation from the antenna in a desired direction.

2. The holographic antenna of claim 1 wherein a respective bias line is coupled to a respective tuning device for controlling the respective tuning device of the plurality of tuning devices to be shorted to the transmission line structure or to be not shorted to the transmission line structure to reconfigure the respective reconfigurable radiating element to tune a frequency of operation of the antenna.

3. The holographic antenna of claim 1 wherein the transmission line structure comprises:

a rectangular waveguide, a ridged waveguide, a coaxial transmission line, or a parallel plate waveguide.

4. The holographic antenna of claim 1 wherein the transmission line structure comprises:

a dielectric waveguide, a microstrip line, or an impedance surface-wave waveguide.

5. The holographic antenna of claim 1 wherein each of the plurality of reconfigurable radiating elements comprises:

a straight slot, a bent slot, an annular ring, a split ring, or a slot having an arbitrary geometry.

6. The holographic antenna of claim 1 wherein each of the plurality of tuning devices comprises:

a field effect transistor (FET), a micro-electro-mechanical systems (MEMS) switch, or a phase change material (PCM) switch.

7. The holographic antenna of claim 1:

wherein the plurality of tuning devices coupled to and arranged along the respective reconfigurable radiating element are uniformly or non-uniformly spaced along the respective reconfigurable radiating element.

8. The holographic antenna of claim 1 further comprising:

a plurality of integrated circuits, each respective integrated circuit coupled to a respective reconfigurable radiating element, each respective integrated circuit comprising:

a tuning control input;

a decoder coupled to the tuning control input; and a plurality of outputs of the decoder coupled to a respective tuning device of the plurality of tuning devices coupled to the respective reconfigurable radiating element for controlling the respective tuning device to be shorted to the transmission line structure or to be not shorted to the transmission line structure.

9. The holographic antenna of claim 1 further comprising:

a dielectric;

wherein the transmission line structure comprises:

a first metallic layer on a top layer of the dielectric;

a second metallic layer on an internal layer of the dielectric; and a plurality of metallic vias coupled between the first metallic layer and the second metallic layer.

10. The holographic antenna of claim 9:

wherein the bias line extends below the second metallic layer.

11. The holographic antenna of claim 1:

wherein each of the reconfigurable radiating elements comprises a slot; and wherein each of the tuning devices comprises a field effect transistor.

12. A holographic antenna comprising:

a rectangular waveguide;

a plurality of radiating elements located along a length of the rectangular waveguide;

a plurality of tuning devices coupled to and arranged along a respective radiating element of the plurality of radiating elements; and a plurality of bias lines, wherein a respective bias line is coupled to a respective tuning device for controlling the respective tuning device of the plurality of tuning devices to be shorted to the transmission line structure or to be not shorted to the transmission line structure;

wherein the plurality of tuning devices has a uniform or non-uniform spacing along the respective radiating element.

13. The holographic antenna of claim 12:

wherein each of the respective radiating elements comprises a slot; and wherein each of the tuning devices comprises a field effect transistor.

14. The holographic antenna of claim 12 wherein the rectangular waveguide comprises:

a first metallic layer on a top layer of a dielectric;

a second metallic layer on an internal layer of the dielectric; and a plurality of metallic vias coupled between the first metallic layer and the second metallic layer.

15. The holographic antenna of claim 14:

wherein the plurality of bias lines extend below the second metallic layer.

16. A method of providing a holographic antenna comprising:

providing a transmission line structure;

forming a plurality of radiating elements in a top layer of the transmission line structure along a length of the transmission line structure;

providing a plurality of tuning devices coupled to and arranged along a respective radiating element of the plurality of radiating elements; and controlling a respective tuning device of the respective radiating element to be shorted to the transmission line structure or to be not shorted to the transmission line structure.

17. The method of claim 16 further comprising:

providing a plurality of bias lines, wherein a respective bias line is coupled to a respective tuning device for controlling the respective tuning device to be shorted to the transmission line structure or to be not shorted to the transmission line structure.

18. The method of claim 16:

wherein each of the radiating elements comprises a slot; and wherein each of the tuning devices comprises a field effect transistor.

19. The method of claim 16 wherein providing a transmission line structure further comprises:

providing a printed circuit board having multiple layers;

forming a metallic top layer of a transmission line structure on top of the printed circuit board;

forming a metallic bottom layer of the transmission line structure on an internal layer of the printed circuit board; and forming a plurality of metallic vias coupled between the top layer of the transmission line structure and the bottom layer of the transmission line structure to form side walls of the transmission line structure.

20. The method of claim 16 wherein the plurality of tuning devices has a uniform or non-uniform spacing along the respective reconfigurable radiating element.

* * * * *